United States Patent [19]

Louden

[11] 4,240,595

[45] Dec. 23, 1980

[54] END CAP FOR CLOTH REEL

[75] Inventor: Samuel Louden, Cinnaminson, N.J.

[73] Assignee: National Tube & Reel Corporation, Delran, N.J.

[21] Appl. No.: 6,630

[22] Filed: Jan. 26, 1979

[51] Int. Cl.[3] ..... B65H 75/06

[52] U.S. Cl. ..... 242/222

[58] Field of Search ..... 242/222, 61, 71.8, 118.8; 206/389, 413, 415, 416

[56] References Cited

U.S. PATENT DOCUMENTS

| | | | |
|---|---|---|---|
| 695,062 | 3/1902 | Lonke | 242/222 |
| 1,659,282 | 2/1928 | Scheffey | 242/222 |
| 1,966,191 | 7/1934 | Strohofer | 242/222 |
| 3,062,368 | 11/1962 | Dunn | 242/222 |
| 4,126,286 | 11/1978 | Dunn | 242/222 |

*Primary Examiner*—Leonard D. Christian

*Attorney, Agent, or Firm*—Michael F. Petock

[57] ABSTRACT

An end cap for a paper board reel of unitary construction which is designed to be applied in an economical manner by production machinery and provides a smooth arcuate surface which avoids injury to cloth to be wound thereon.

5 Claims, 4 Drawing Figures

END CAP FOR CLOTH REEL

BACKGROUND OF THE INVENTION

The present invention relates to an end cap for a cloth reel. More particularly, the present invention relates to an end cap for a cloth reel which provides a smooth arcuate surface at the reel end and which may be applied in an economical manner by production machinery.

In the recent past, cloth reels are now usually constructed of cardboard, as contrasted to wooden boards, and are provided with protecting end caps at opposite ends of the paper board reel construction. These end caps usually consisted of a face extending across the end of the cardboard reel with sides folded from the face along the opposite broad surfaces of the reel. Oftentimes, the end caps were of a folded construction having rather sharp square corners, such as in U.S. Pat. Nos. 1,966,191-Strohofer and 3,341,000-McKittrick et al. These patents also disclose the use of end flaps which required taping as shown in McKittrick et al.

More recently, U.S. Pat. No. 4,126,286-Dunn has been issued for an end cap for a cloth reel which provided rounded corners. Applicant herein has provided a novel and unobvious structure for an end cap for a cloth reel which provides rounded corners in an economical construction which may be applied to the reels by production machinery in an efficient and economical manner.

SUMMARY OF THE INVENTION

The end cap of the present invention provides a smooth arcuate surface when applied to a cloth reel. The rounded or arcuate surface of the end cap may be formed around the cloth reel in a single machine step. The end caps of the present invention have a definite orientation and may be pre-printed prior to applying them to the reels.

Briefly and basically, the present invention comprises an end cap for a cloth reel which may be die cut sheets of material. The end cap is comprised of a front wall and a pair of articulated side walls integral therewith. One of the side walls is provided with extensions on each end to wrap around the longitudinal edge of the cloth reel to form a substantially smooth arcuate surface for the reel. In a preferred embodiment, the front wall is provided with a pair of articulated end walls extending from the lateral ends of the front wall wherein the end walls may be wrapped over the longitudinal sides of the reel. Additionally, in the preferred embodiment, the grain of the end cap is oriented to extend across the narrow dimension of the end cap so that the extensions on the sidewalls may be bent without creasing.

BRIEF DESCRIPTION OF THE DRAWINGS

For the purpose of illustrating the invention, there are shown in the drawings forms which are presently preferred, it being understood, however, that this invention is not limited to the precise arrangements and instrumentalities shown.

DETAILED DESCRIPTION OF THE PREFERRED EMBODIMENTS

Figure 1:
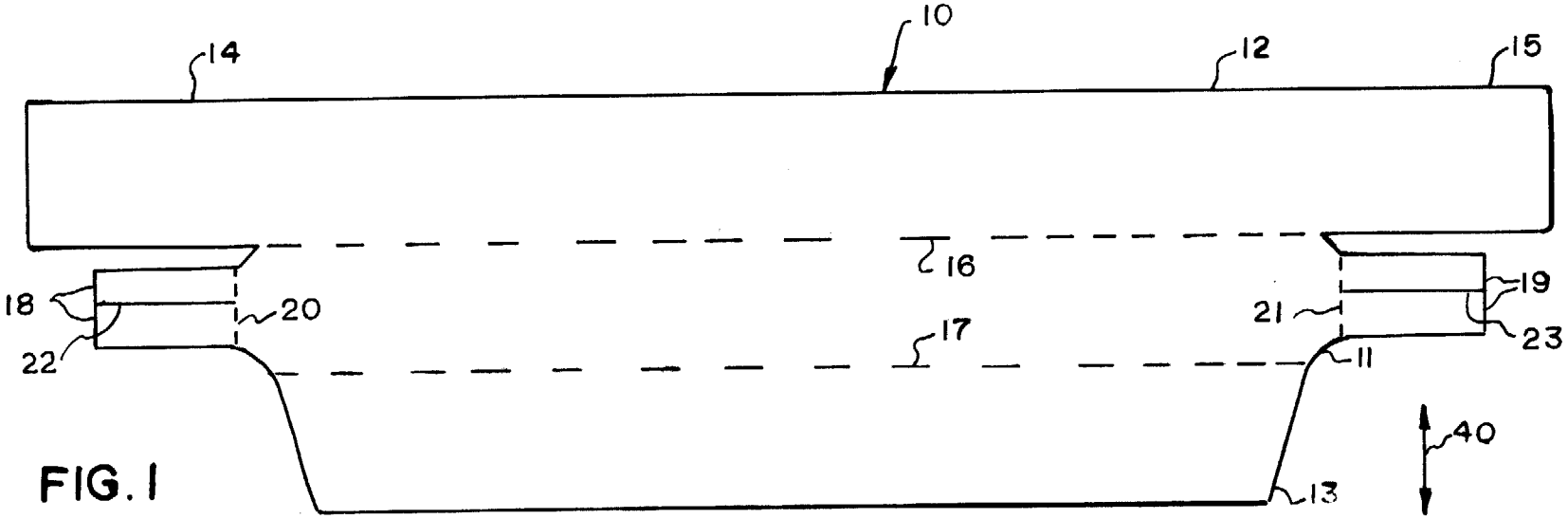
FIG. 1 is a top plan view of an end cap in accordance with the present invention as die cut from a piece of cardboard before being applied to a reel.

Referring now to the drawings in detail wherein like numerals indicate like elements, there is shown in FIG. 1 an end cap 10 having a front wall 11 with a pair of articulated side walls 12 and 13 integral therewith. Side wall 12 is provided with extensions 14 and 15. Side walls 12 and 13 are integral with front wall 11 and the dotted lines 16 and 17 indicate score lines for ease in folding when the end cap is applied to the reel.

Front wall 11 is provided with a pair of articulated end walls 18 and 19 which extend laterally from the ends of the front wall. These are connected to the front wall and are provided with score lines 20 and 21 for ease in bending when the end cap is applied to the reel. The end walls 18 and 19 are die cut along lines 22 and 23 so that the end walls may form a closer fit to the arcuate longitudinal edges of the reel when the end cap is applied to the reel.

Figure 2:
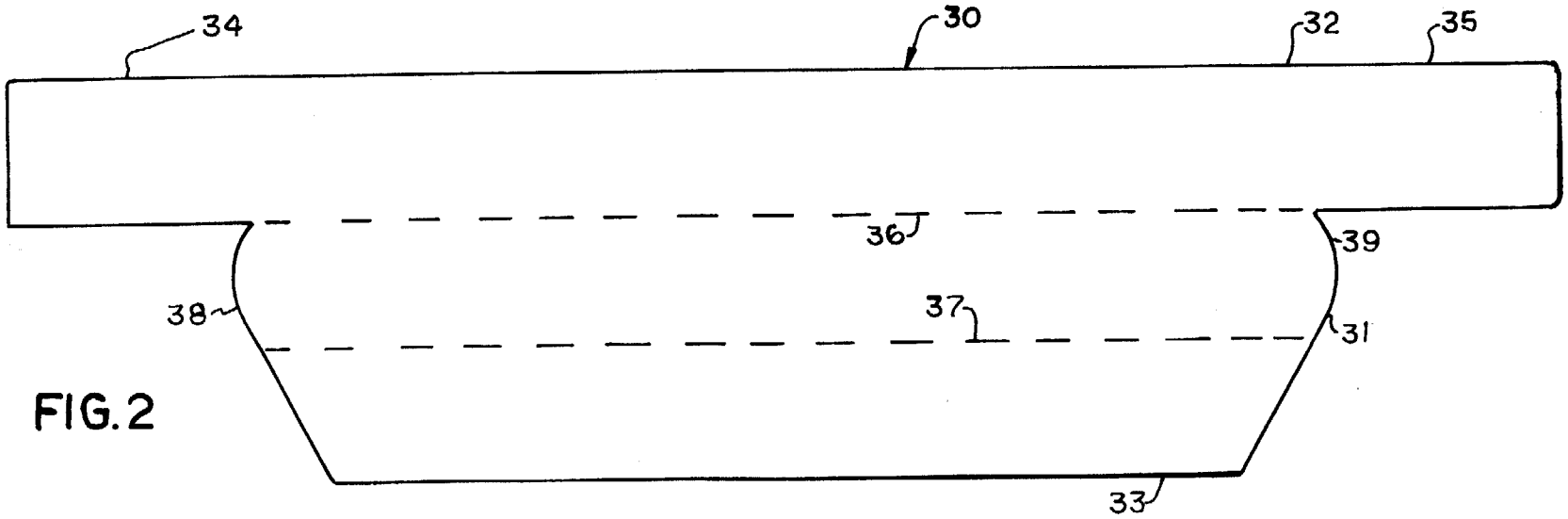
FIG. 2 is a top plan view of another end cap in accordance with another embodiment of the present invention as die cut from a piece of cardboard before being applied to a reel.

Referring now to FIG. 2, there is shown another embodiment of an end cap 30 for a paper board cloth reel. The end cap 30 is similar to end cap 10 except that end walls are not provided. End walls 18 and 23 shown in FIG. 1 are not necessary, but are preferred in that they provide a smooth closed end when they are tucked over the longitudinal end of the reel as described hereinafter with respect to FIGS. 3 and 4. End cap 30 may be die cut from a piece of cardboard to form a front wall 31 and side walls 32 and 33. Side wall 32 is provided with extensions 34 and 35 similar to extensions 14 and 15 of FIG. 1. Score lines 36 and 37 are provided to aid in folding side walls 32 and 33 over the broad faces of the reel. The lateral ends of front wall 31 are provided with arcuate shaped edges 38 and 39 which preferably conform to the shape of the longitudinal edges of the reel.

During the die cutting operation of end caps 10 and 30, the grain of the cardboard blank is preferably oriented in the direction of double headed arrow 40. Orientation in this direction reduces the likelihood of creasing of the extensions 14, 15, 34 and 35 when the extensions are machine molded or bent around the longitudinal edges of the reel.

Figure 3:
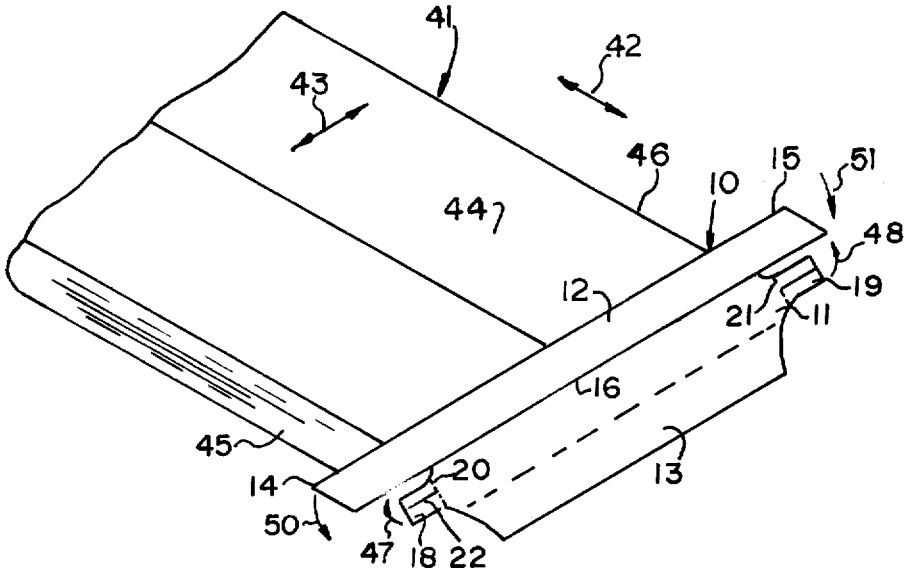
FIG. 3 is a perspective view of one end of a cloth reel with an end cap in accordance with the embodiment shown in FIG. 1 partially applied to the reel.
Figure 4:
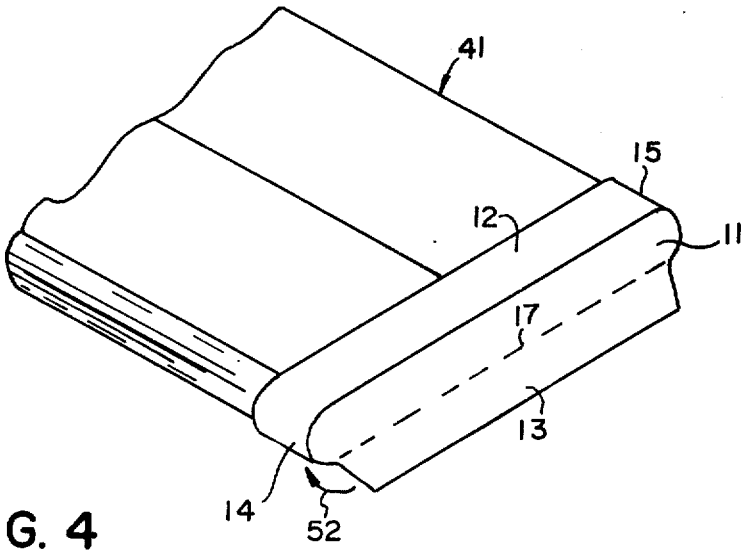
FIG. 4 is a perspective view of one end of a reel with an end cap applied except for the folding over of the remaining side wall.

Referring now to FIGS. 3 and 4, there is shown a portion of a cloth board reel 41 having a longitudinal dimension in the direction of double headed arrow 42 and a transverse dimension in the direction of double headed arrow 43. FIGS. 3 and 4 illustrate the method of applying the end cap to the reel which may be done by machine. FIG. 3 illustrates the end cap 10 as first applied and FIG. 4 illustrates the end cap just before the last step.

Referring now to FIG. 3, with the side of the end cap facing the reel first having been coated with an adhesive, the end cap 10 is applied to the reel and folded along score line 16 so that side wall 12 is adhesively bonded to broad surface 44 of reel 41 along the transverse end of the reel and front wall 11 is adhesively bonded to the end of the reel.

The next step, which may also be done by machine, is the folding over of end walls 18 and 19 along the longitudinal edges 45 and 46, respectively, of reel 41. The folding of end walls 18 and 19 is aided by the presence of score lines 20 and 21, respectively. Arrows 47 and 48 indicate the direction of the motion of end walls 18 and 19. The serrations or cuts 22 and 23 in end walls 18 and 19, respectively, allow for folded end walls 18 and 19 to conform more closely to the rounded longitudinal edges 45 and 46 of the reel 41.

In the next step, referring now to FIGS. 3 and 4, the extensions 14 and 15 of side wall 12 are bent or molded, preferably by machine operation, around the longitudinal edges 45 and 46, respectively, as shown in FIG. 4. The direction of motion of the bending or arcuate molding of the extensions 14 and 15 is in the direction of arrows 50 and 51 to form a substantially smooth arcuate surface for the reel as shown in FIG. 4. The last step in the application of the end cap is the folding over of side wall 13 along the score line 17 in the direction of arrow 52 as shown in FIG. 4. Although the end cap for one side of the reel has been illustrated, it is understood that both ends of the reel may, and preferably are, provided with a similar type end cap, and that in the manufacturing operation, both end caps may be applied simultaneously. The end caps may also be printed on front wall 11 prior to application to the reel thereby avoiding a subsequent step of applying labels to the end cap.

The present invention may be embodied in other specific forms without departing from the spirit or essential attributes thereof and, accordingly, reference should be made to the appended claims, rather than to the foregoing specification as indicating the scope of the invention.

I claim:

1. In a reel for cloth having a longitudinal dimension and a transverse dimension, a cardboard end cap extending about each transverse end of the reel and comprising a front wall and a first and second articulated side walls integral therewith, said first side wall being provided with extensions on each end to wrap around the longitudinal edge of the cloth reel to form a substantially smooth arcuate surface for the reel, said second articulated side wall having a length equal to or less than the width of said reel, each extension of said first side wall being wrapped around one of the longitudinal edges of the reel and said second side wall being folded onto a broad face of the reel over the end of said wrapped extensions of said first side wall.

2. The end cap in accordance with claim 1 wherein said front wall is provided with a pair of articulated end walls extending from the lateral ends of the front wall.

3. An end cap in accordance with claim 2 wherein said end walls are provided with a serration substantially in the direction of the longitudinal dimension of the reel.

4. An end cap in accordance with claim 1 wherein said end cap is die cut from cardboard having a grain substantially transverse to the longitudinal dimension of the side walls and substantially parallel to the longitudinal dimension of the reel.

5. An end cap in accordance with claim 1 wherein said second side wall is provided with tapered ends.

* * * * *